US007522110B2

(12) United States Patent
Wu

(10) Patent No.: US 7,522,110 B2
(45) Date of Patent: Apr. 21, 2009

(54) MONOPOLE ANTENNA AND WIRELESS NETWORK DEVICE HAVING THE SAME

(75) Inventor: Jung Tai Wu, Taipei (TW)

(73) Assignee: Cameo Communications, Inc., Sihih, Taipei County (TW)

( * ) Notice: Subject to any disclaimer, the term of this patent is extended or adjusted under 35 U.S.C. 154(b) by 19 days.

(21) Appl. No.: 11/812,354

(22) Filed: Jun. 18, 2007

(65) Prior Publication Data

US 2008/0309570 A1 Dec. 18, 2008

(51) Int. Cl.
*H01Q 1/24* (2006.01)
*H01Q 1/38* (2006.01)

(52) U.S. Cl. ..... 343/702; 343/700 MS

(58) Field of Classification Search ..... 343/702
See application file for complete search history.

(56) References Cited

U.S. PATENT DOCUMENTS 6,342,860 B1 * 1/2002 Haussler et al. ..... 343/702
7,123,197 B2 * 10/2006 Suzuki ..... 343/702
2007/0046543 A1 * 3/2007 Choi et al. ..... 343/700 MS
2007/0273590 A1 * 11/2007 Lim et al. ..... 343/702
2008/0266180 A1 * 10/2008 Wu ..... 343/700 MS

* cited by examiner

*Primary Examiner*—Trinh V Dinh
(74) *Attorney, Agent, or Firm*—Troxell Law Office, PLLC

(57) ABSTRACT

The present invention discloses an antenna adapted for use in a wireless network device. The antenna includes: a base radiation portion, a connecting portion, a first radiation portion and a second radiation portion. The connecting portion is connected with the base radiation portion and has a slot with two slot sides that are spaced with a first width. The first radiation portion is connected with the connecting portion. The second radiation portion is connected with the first radiation portion, substantially parallel to the connecting portion, and is positioned corresponding to the slot. The second radiation portion has two edges that are spaced with a second width. When the second radiation portion is projected onto the connecting portion along a direction perpendicular to the second radiation portion, one of the edges and one of the corresponding slot sides are spaced with a distance. The antenna is a single component integrally formed by stamping an electrically conductive thin metal plate, which facilitates not only fabrication thereof, but also the assembly of the antenna to a substrate of the wireless network device, and increases the gain of the wireless network device along a vertical direction as well.

16 Claims, 9 Drawing Sheets

MONOPOLE ANTENNA AND WIRELESS NETWORK DEVICE HAVING THE SAME

BACKGROUND OF INVENTION

1. Field of the Invention

The present invention relates to antennas, and more particularly, to an integrally formed and uni-planar plated ultra wideband (UWB) monopole antenna adapted for use in wireless network devices, and a wireless network device with the antenna.

2. Description of the Prior Art

Referring to FIG. 1, which is a perspective view of a conventional wireless network device 10 of, for example, a wireless network card. The wireless network device 10 usually includes a main body 11, an internal circuit apparatus 12 located inside the main body 11, a connector portion 13 located at one end of the main body 11 for connecting an external main unit (not shown), and a radio signal receive/transmit portion 14 located at an end of the main body 11 opposing the connector portion 13. Generally, the radio signal receive/transmit portion 14 is provided with an outer casing that is made of a non-metal material. When the wireless network device 10 is connected to the external main unit, the radio signal receive/transmit portion 14 must be exposed outside of the external main unit so as to effectively receive and transmit radio signals.

Referring to FIG. 2, which is a schematic view of a conventional internal circuit apparatus 20 of wireless network devices. The conventional internal circuit apparatus 20 wireless network device includes a substrate 21, a control circuit 22 located on the substrate 21, a ground portion 23 covering a predetermined area of the substrate 21, and an antenna unit 24 electrically connected to the control circuit 22. The conventional antenna unit 24, as illustrated in FIG. 2, includes a first antenna 241 and a second antenna 242 located at two lateral sides of the substrate 21, respectively. Since the antenna unit of this conventional internal circuit apparatus 20 is designed as printed monopole antenna printed on the substrate 21. Due to limitation in height difference along a vertical direction, this type of printed antenna can achieve a better radiation field profile and higher gain on an X-Y plane (horizontal plane) only by making different shapes of the first antenna 241 and the second antenna 242; but there is little room for further improvement of antenna gain along the vertical Z direction. However, the design of current wireless network device tends to be vertical stand type, so as to reduce the space occupied by the wireless network device, as well as to make the appearance of the wireless network device more modern and high-tech. It is obvious that the conventional printed antenna cannot meet the requirement for the vertical stand type wireless network device due to the poor gain along the vertical Z direction.

For example, referring to FIG. 3, which is a chart showing a radiation field profile measured on an X-Y plane of the first antenna of the conventional antenna unit 24 as shown in FIG. 2. From the radiation field profile of FIG. 3, it can be seen that the peak gain of the first antenna 241 along the vertical direction is only −15.89 dBi, which is apparently lower than the minimum standard accepted by consumers (a general requirement is that the gain should be at least greater than −10 dBi). Thus, there is still room for improvement regarding to the design of antenna, which is also critically important for meeting the need for high performance antenna from consumers.

SUMMARY OF INVENTION

A first objective of the present invention is to provide a uni-planar plated UWB monopole antenna that facilitates fabrication and reduces cost by using a stamping process to integrally form a uni-planar three-dimensional antenna.

A second objective of the present invention is to provide an antenna adapted for use in a wireless network device, which can be quickly assembled to the wireless network device by means of an insert type design of the antenna, and has an antenna radiation field profile that increases the gain along a vertical direction and reduces dead angle.

In order to achieve the above mentioned objectives, the present invention provides a monopole antenna adapted for use in a wireless network device. The antenna includes: a base radiation portion, a connecting portion, a first radiation portion and a second radiation portion. The connecting portion is connected with the base radiation portion and has a slot with two slot sides that are spaced with a first width. The first radiation portion is connected with the connecting portion. The second radiation portion is connected with the first radiation portion, substantially parallel to the connecting portion, and is positioned corresponding to the slot. The second radiation portion has two edges that are spaced with a second width. When the second radiation portion is projected onto the connecting portion along a direction perpendicular to the second radiation portion, one of the edges and one of the corresponding slot sides are spaced with a distance. The antenna is a single component integrally formed by stamping an electrically conductive thin metal plate, which facilitates not only fabrication thereof, but also the assembly of the antenna to a substrate of the wireless network device, and increases the gain of the wireless network device along a vertical direction as well.

In a preferred embodiment, the present invention also provides a wireless network device which comprises:

a substrate made of a dielectric material, the substrate having a plurality of openings defined therein;

a control circuit formed on the substrate and configured to provide wireless network transmitting function;

at least one feed line coupled to the control circuit; and at least one antenna, the antenna further comprising:

a base radiation portion comprising at least one latch portion and a signal portion, the latch portion being latched into one of the corresponding openings, making the base radiation portion contact with the substrate, the signal portion being coupled to the feed line;

a connecting portion connected with the base radiation portion and being substantially perpendicular to the base radiation portion, the connecting portion having a slot with two parallel slot sides that are spaced with a first width;

a first radiation portion connected with the connecting portion and being substantially perpendicular to the connecting portion; and a second radiation portion connected with the first radiation portion, the second radiation portion being substantially parallel to the connecting portion and positioned corresponding to the slot, the second radiation portion having two edges that are substantially parallel to each other and spaced with a second width, wherein when the second radiation portion is projected onto the connecting portion along a direction perpendicular to the second radiation portion, one of the edges and one of the corresponding slot sides are substantially parallel to each other and spaced with a distance.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE EMBODIMENTS

Figure 1:
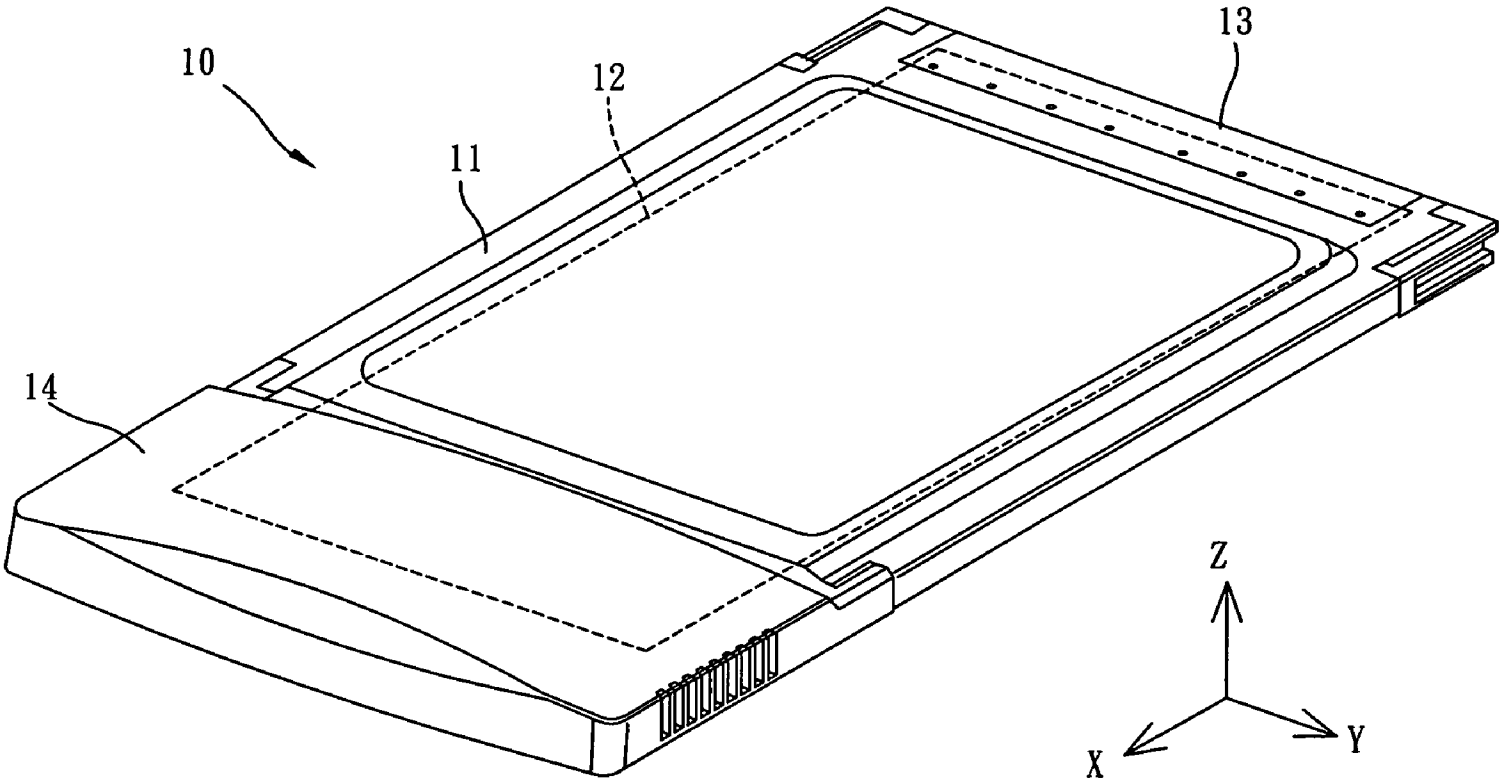
FIG. 1 (PRIOR ART)
FIG. 1 is a perspective view of a typical wireless network device.
Figure 2:
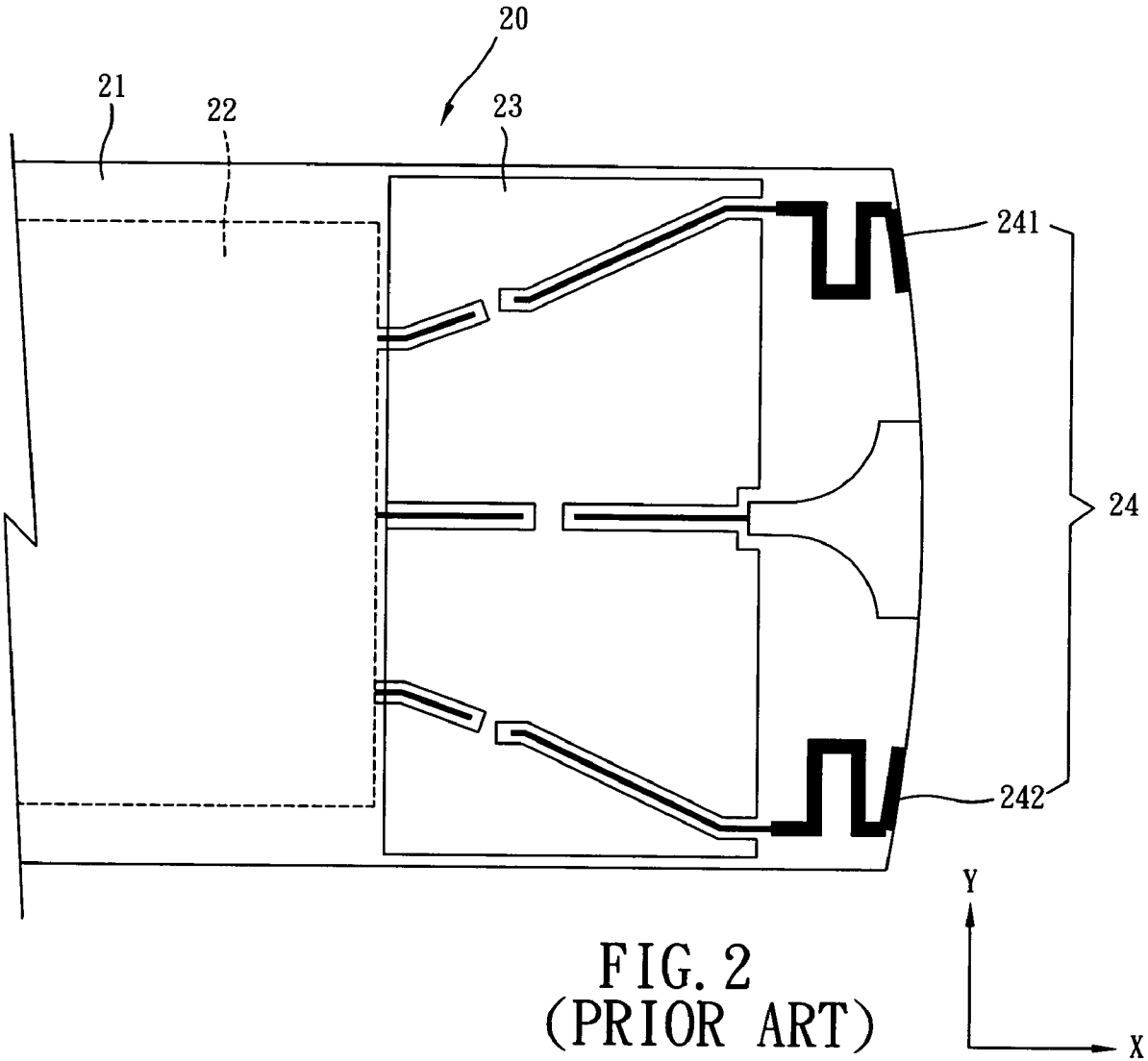
FIG. 2 (PRIOR ART)
FIG. 2 is a schematic view of a conventional internal circuit apparatus of the wireless network device.

The main principle of the UWB monopole antenna and the wireless network device having the antenna according to the present invention is that, a three-dimensional antenna is integrally formed by using a stamping process and the antenna can be quickly assembled to a substrate of the wireless network device. This not only achieves a higher gain along a vertical direction, but also facilitates fabrication and assembly, and further reduces cost.

Referring to FIGS. 4 and 5A through 5C, which are the perspective view and three-dimensional view of a UWB monopole antenna in accordance with a preferred embodiment of the present invention. The UWB monopole antenna 5 of the present invention is a uni-planar plated component integrally formed by employing a stamping process to bend an electrically conductive thin metal plate (for example, copper, iron, aluminum). Therefore, the antenna 5 is of an even thickness t, except at the bended areas. The antenna 5 includes a base radiation portion 51, a connecting portion 52, a first radiation portion 53, and a second radiation portion 54. The connecting portion 52 is connected with the base radiation portion 51, formed by bending a connecting side 511 of the base radiation portion 51, and is generally perpendicular to the base radiation portion 51. The base radiation portion 51 at a free side 512 thereof opposite to the connecting side 511 is of a predetermined shape. In a preferred embodiment of the present invention, the shape has at least a vertex 513. The vertex 513 is located approximately at a middle position of the free side 512, and is substantially the farthest point on the free side 512 away from the connecting portion 52, while two end points 514 of the free side 512 are substantially the nearest points on the free side 512 to the connecting portion 52, thereby making the base radiation portion 51 a pentagon in shape.

The first radiation portion 53 is connected with the connecting portion 52, formed by bending the connecting portion 52, and is generally perpendicular to the connecting portion 52 and thus generally parallel to the base radiation portion 51. A shape of a peripheral edge of the first radiation portion 53 generally corresponds to that of the base radiation portion 51, except at a free side 532 of the first radiation portion 53, which has no shape corresponding to the vertex 513 of the base radiation portion 51 due to formation of the second radiation portion 54 by bending the free side 532 of the first radiation portion 53, and is linear. The second radiation portion 54 is connected with the first radiation portion 53 and is generally parallel to the connecting portion 52, thereby forming a distance d between the second radiation portion 54 and the connecting portion 52. The second radiation portion 54 includes two generally parallel edges 541 that are spaced with a second width W2. The edges 541 extend to have a length L. By configuring the length L, a frequency of the antenna 5 can be adjusted.

The connecting portion 52 further has a slot 55 defined therein. The slot 55 has two first slot sides 551 adjacent to the first radiation portion 53, wherein the first slot sides 551 are generally parallel to each other and spaced with a first width W1. The slot 55 has two second slot sides 552 adjacent to the base radiation portion 51, wherein the second slot sides 552 are generally parallel to each other and spaced with a third width W3. The third width W3 is greater than the first width W1, thus the slot 55 has an inclined side 553 at an angle θ to the first slot sides 551. When the second radiation portion 54 is projected onto the connecting portion 52 along a direction 91 perpendicular to the second radiation portion 54, the edges 541 and the first slot sides 551 are generally parallel to each other, and since the first width W1 is greater than the second width W2, each edge 541 and one of the corresponding first slot sides 551 are spaced with a distance s.

The base radiation portion 51 further includes a signal portion 515 and at least one latch portion 516. The signal portion 515 is coplanar with the base radiation portion 51 and located approximately at a middle position of the connecting side 511, while the latch portion 516 is connected with the base radiation portion 51 and generally perpendicular to the base radiation portion 51. In a preferred embodiment of the present invention, the number of the latch portions 516 is two and the two latch portions 516 are located adjacent to the two end points 514, respectively. It will be apparent to those skilled in the art that variation in the number of the latch portions can be made in view of the above description without departing from the principle of the present invention and the scope and spirit of the invention, which will not be described herein in further details.

Figure 6:
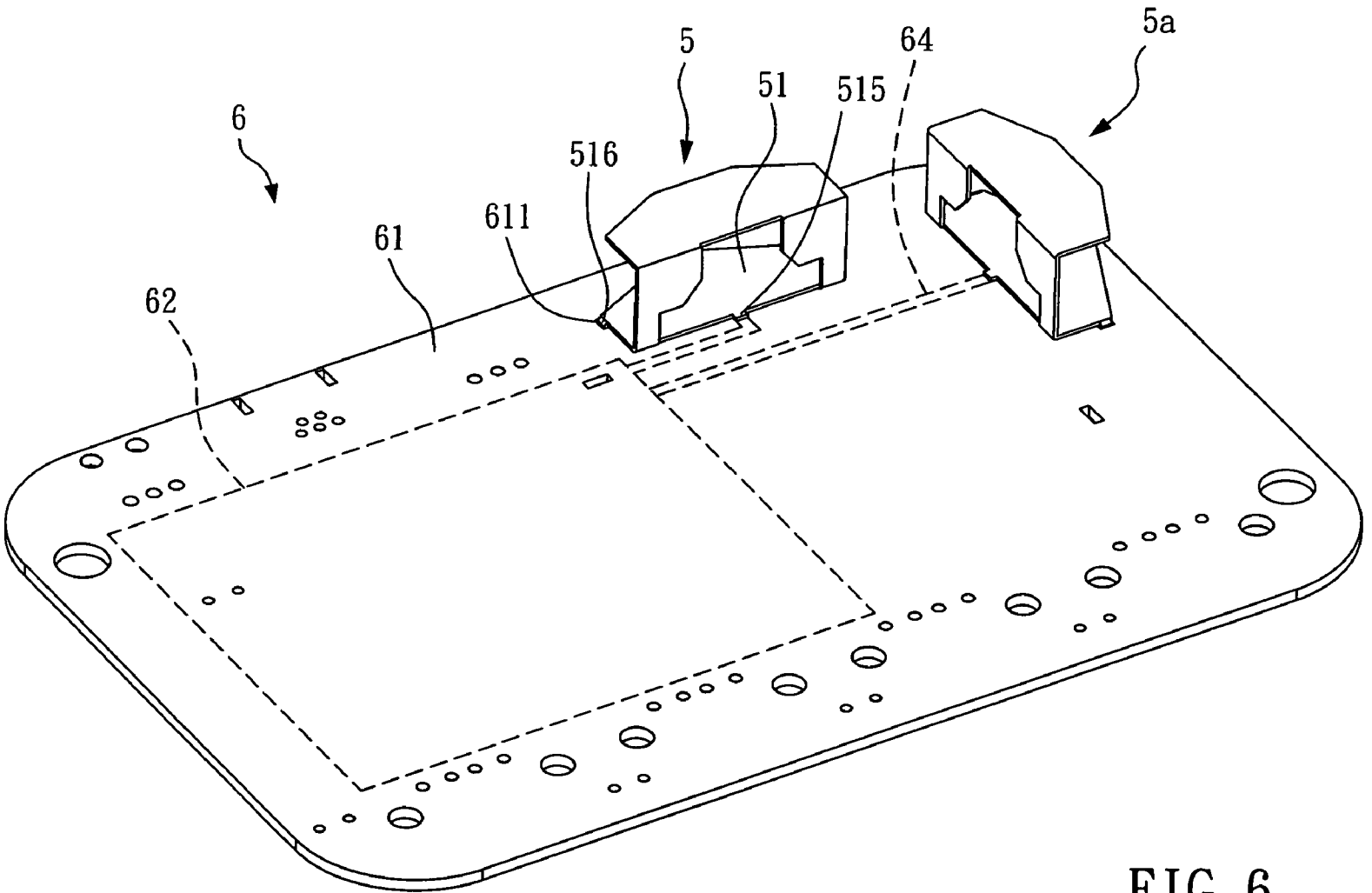
FIG. 6 is a schematic view showing a preferred embodiment of an internal circuit apparatus of a wireless network device having the antenna of the present invention.

Referring to FIG. 6, which is a schematic view showing a preferred embodiment of an internal circuit apparatus of a wireless network device with the antenna of the present invention. The wireless network device 6 of the present invention includes a substrate 61, a control circuit 62, at least one feed line 64, and at least one antenna 5, 5*a* of the present invention. The substrate 61 is made of a dielectric material and made into a substantially low-profile rectangular substrate 61. The substrate 61 has a plurality of openings 611 defined therein. The control circuit 62 is formed on the substrate 61, including circuit layout, a plurality of IC components and electronic components, and is capable of providing wireless network transmitting function. The control circuit 62 can use conventional technology and is not a main feature of the present invention; therefore, the configuration of the control circuit 62 is not described herein in details.

In this preferred embodiment, most elements of the antenna 5, 5*a* are the same as or similar to the ones in the foregoing embodiment, therefore the same elements will be given the same names and reference numbers. The number of the antennas 5, 5*a* is two and the antennas 5, 5*a* are positioned on the substrate 61 with one substantially perpendicular to the other. The number of the antenna(s) 5 can be one or other number according to needs and the antenna 5 can be arranged on the substrate 61 at predetermined positions or in predetermined fashions, which are not the main features of the present invention and thus are not described hereinafter. The latch portions 516 of the antenna 5 are positioned corresponding to the openings 611; therefore, when the latch portions 516 are latched into corresponding openings 611, the base radiation portion 51 is allowed to contact with a top surface of the substrate 61, the signal portion 515 is coupled to the feed line 64, and the feed line 64 is coupled to the control circuit 62, thereby providing the signal transmission function.

Figure 3:
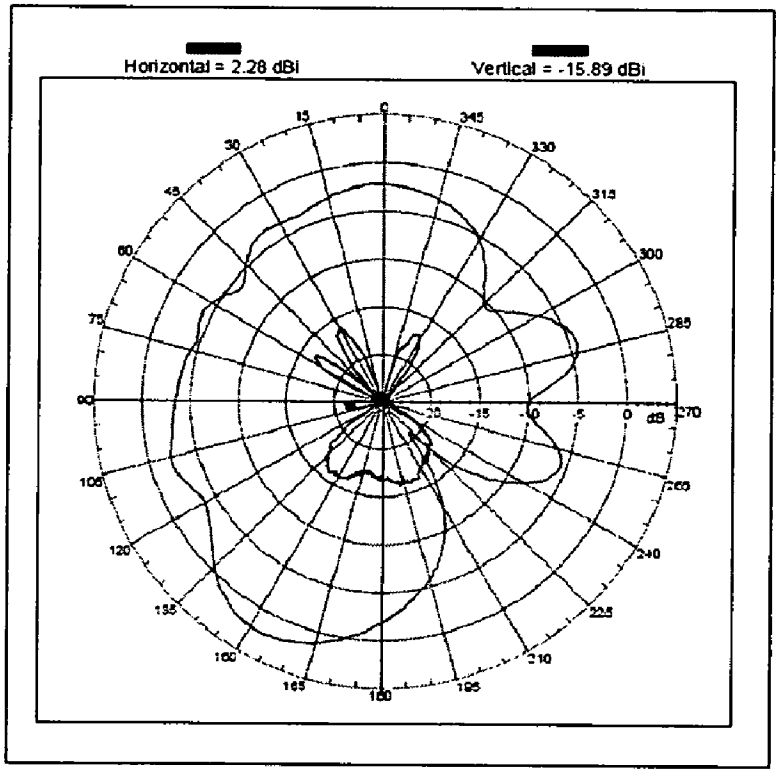
FIG. 3 (PRIOR ART)
FIG. 3 is a chart showing a radiation field profile measured on an X-Y plane of the first antenna of the conventional antenna unit as shown in FIG. 2.
Figure 4:
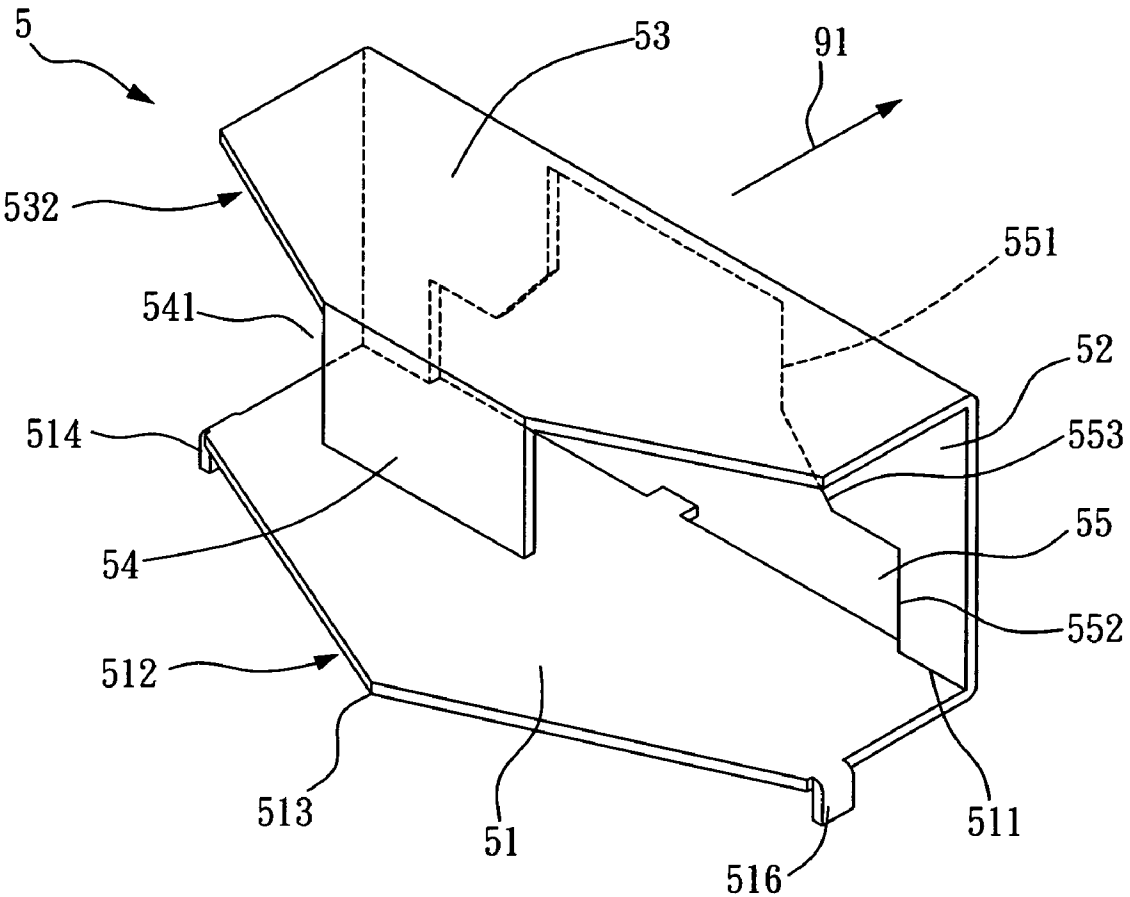
FIG. 4 is a perspective view of a UWB monopole antenna in accordance with a preferred embodiment of the present invention.
Figure 5A:
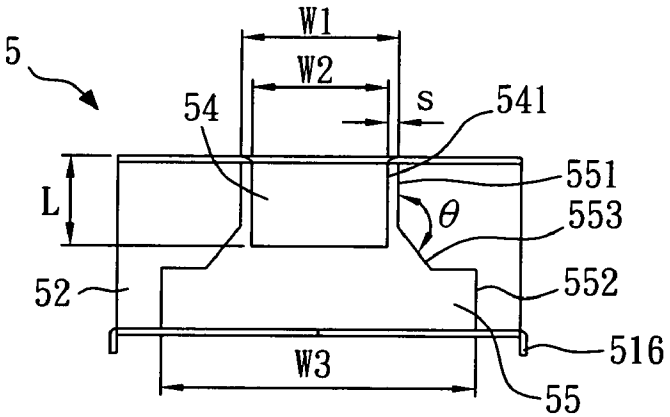
FIG. 5A is a front view of the UWB monopole antenna in accordance with the preferred embodiment of the present invention.
Figure 5B:
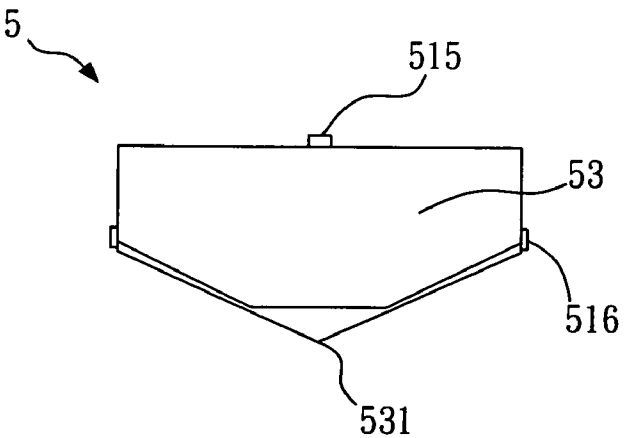
FIG. 5B is a s view of the UWB monopole antenna in accordance with the preferred embodiment of the present invention.
Figure 5C:
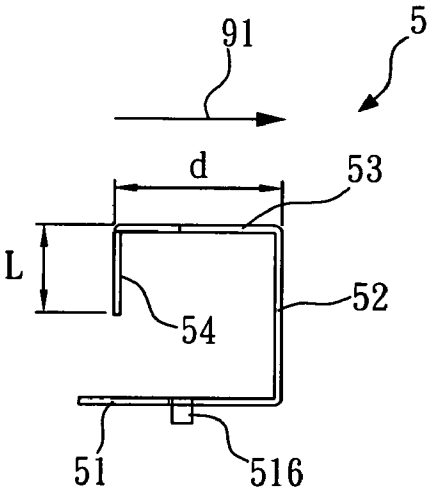
FIG. 5C is a side view of the UWB monopole antenna in accordance with the preferred embodiment of the present invention.
Figure 7A:
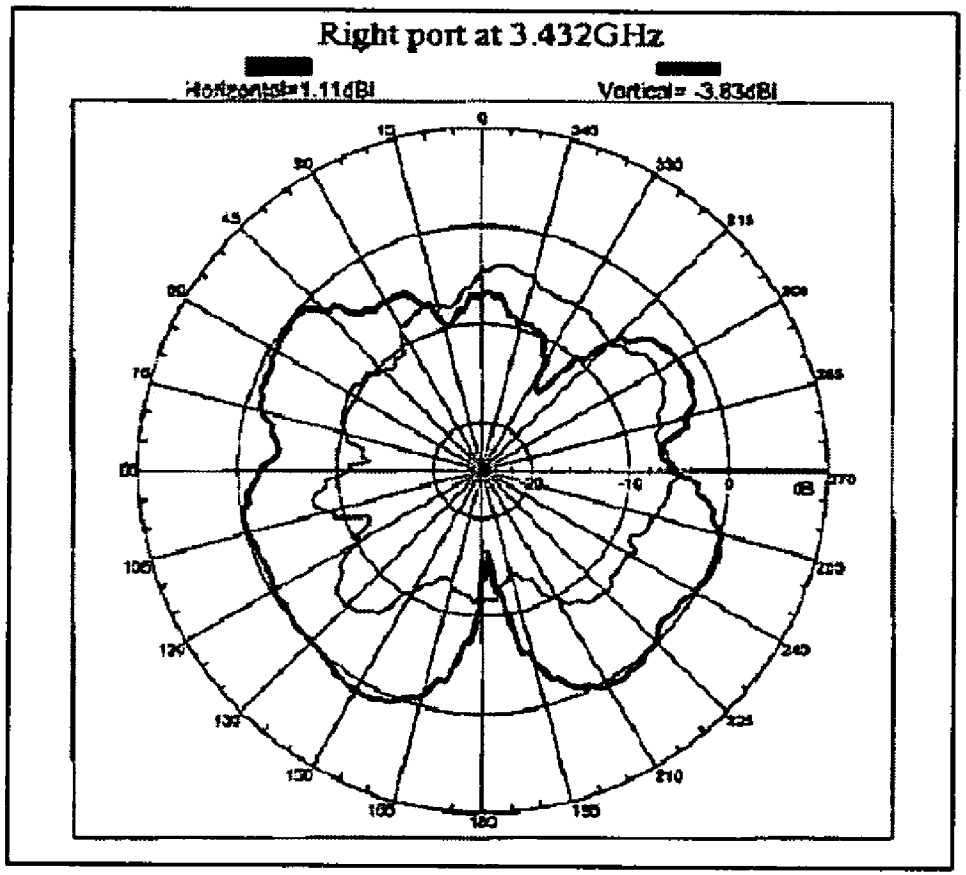
FIG. 7A is a chart showing a radiation field profile measured on an X-Y plane of a left antenna the present invention as shown in FIG. 6 when the antenna is adopted for wideband 3.432 GHz.
Figure 7B:
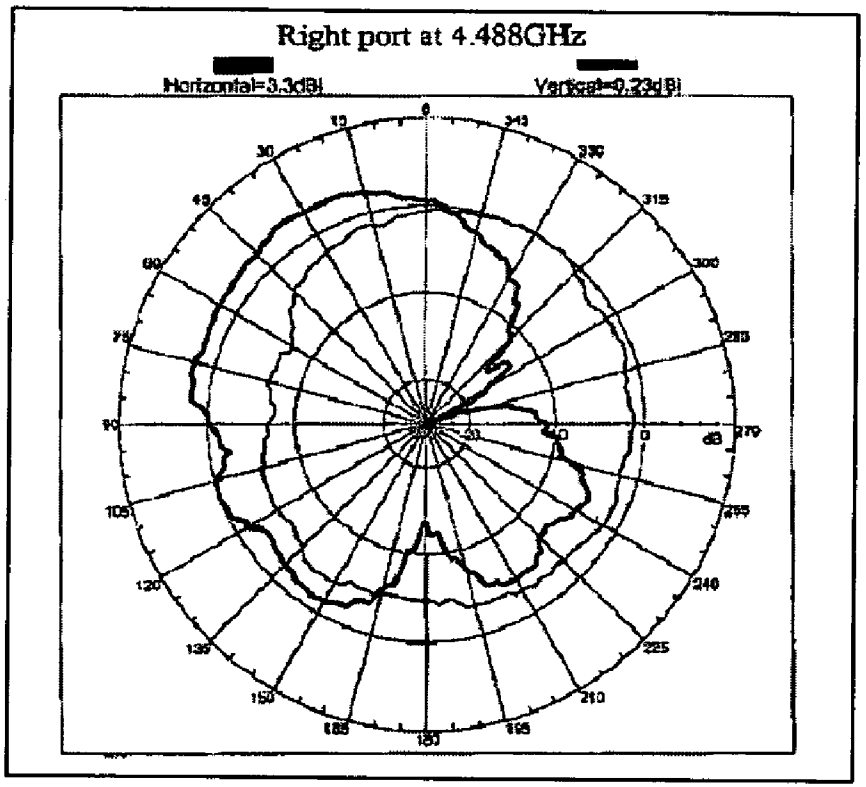
FIG. 7B is a chart showing a radiation field profile measured on the X-Y plane of the left antenna the present invention as shown in FIG. 6 when the antenna is adopted for wideband 4.488 GHz.

Referring to FIGS. 7A and 7B, which are charts showing radiation field profiles measured on an X-Y plane of the left antenna of the present invention as shown in FIG. 6 when the antenna is adopted for wideband 3.432 GHz and 4.488 GHz, respectively. From the radiation field profile of FIG. 7A, it can be seen that, when the left antenna 5 is adopted for wideband 3.432 GHz, the gain of the left antenna S along the vertical direction can be as high as −3.83 dBi; and from the radiation field profile of FIG. 7B, it can be seen that, when the left antenna 5 is adopted for wideband 4.488 GHz, the gain of the left antenna 5 along the vertical direction can be as high as 0.23 dBi, which is apparently much higher than the gain −15.89 dBi of the conventional technology as shown in FIG. 3.

Figure 8:
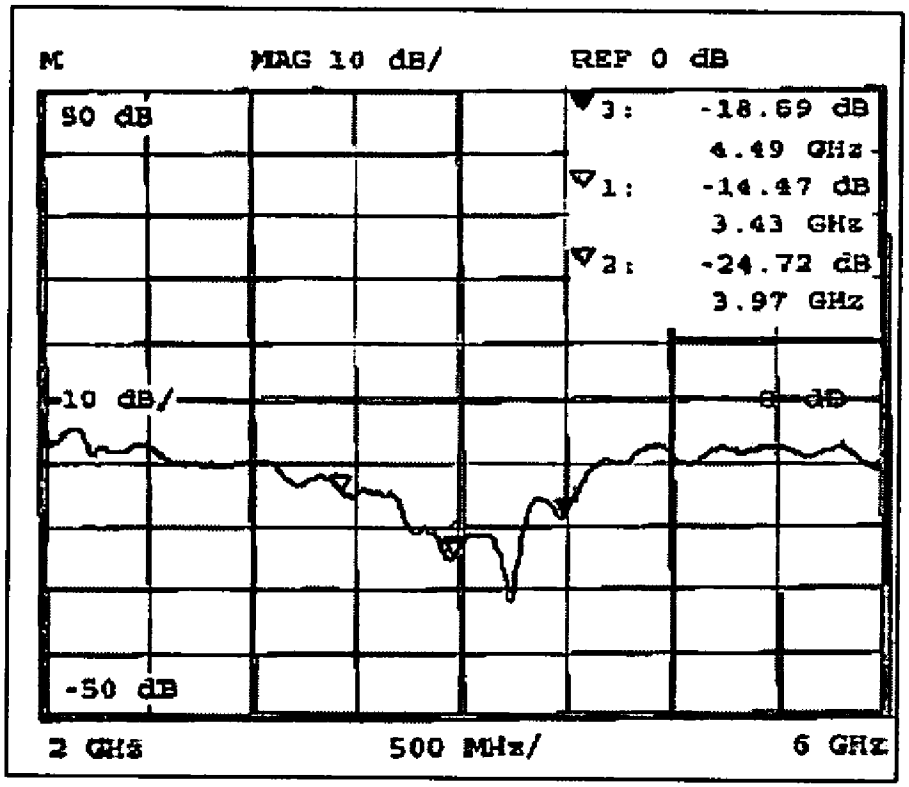
FIG. 8 is a chart showing measurements of input return loss of the antenna of the present invention.

Referring to FIG. 8, which is a chart showing measurements of input return loss of the antenna of the present invention as shown in FIG. 6. From FIG. 8, it can be seen that, when the antenna of the present invention is adopted for 3.43 GHz, 3.97 GHz, and 4.49 GHz, the input return loss of the antenna is −14.47 dBi, −24.72 dBi, and −18.69 dBi, respectively, which are all less than −10 dBi and meet the market need for high performance antenna design. It is understood that the antenna 5 of the present invention not only provides better wireless communication quality and transmission efficiency along the vertical direction than conventional technologies, but also facilitates fabrication and reduces cost by using the stamping process to integrally form the uni-planar plated three-dimensional antenna.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A monopole antenna adapted for a wireless network device, the antenna comprising:

a base radiation portion;

a connecting portion connected with the base radiation portion and being substantially perpendicular to the base radiation portion, the connecting portion having a slot with two parallel slot sides that are spaced with a first width;

a first radiation portion connected with the connecting portion and being substantially perpendicular to the connecting portion; and a second radiation portion connected with the first radiation portion, the second radiation portion being substantially parallel to the connecting portion and positioned corresponding to the slot, the second radiation portion having two edges that are substantially parallel to each other and spaced with a second width;

wherein when the second radiation portion is projected onto the connecting portion along a direction perpendicular to the second radiation portion, one of the edges and one of the corresponding slot sides are substantially parallel to each other and spaced with a distance.

2. The antenna in accordance with claim 1, wherein the antenna is a single three-dimensional component integrally formed by stamping an electrically conductive thin metal plate.

3. The antenna in accordance with claim 1, wherein the first width is greater than the second width.

4. The antenna in accordance with claim 1, wherein the edges extend to have a predetermined length.

5. The antenna in accordance with claim 1, wherein a free side of the base radiation portion is of a predetermined shape.

6. The antenna in accordance with claim 5, wherein a free side of the base radiation portion includes at least one vertex, and the vertex is substantially the farthest point on the free side away from the connecting portion.

7. The antenna in accordance with claim 1, wherein the second radiation portion and the connecting portion are spaced with a distance.

8. The antenna in accordance with claim 1, wherein the base radiation portion further comprises:

a signal portion; and at least one latch portion connected with the base radiation portion and being substantially perpendicular to the base radiation portion.

9. The antenna in accordance with claim 8, wherein the antenna is configured to be inserted into a substrate, the substrate further comprises:

at least one opening, the opening being positioned corresponding to the latch portion, wherein when the latch portion is inserted and mounted into the opening, the base radiation portion of the antenna is in contact with the substrate;

a control circuit configured to provide wireless network transmitting function; and at least one feed line coupling the control circuit with the signal portion.

10. A wireless network device comprising:

a substrate made of a dielectric material, the substrate having a plurality of openings defined therein;

a control circuit formed on the substrate and configured to provide wireless network transmitting function;

at least one feed line coupled to the control circuit; and at least one antenna, the antenna further comprising:

a base radiation portion comprising at least one latch portion and a signal portion, the latch portion being latched into one of the corresponding openings, making the base radiation portion contact with the substrate, the signal portion being coupled to the feed line;

a connecting portion connected with the base radiation portion and being substantially perpendicular to the base radiation portion, the connecting portion having a slot with two parallel slot sides that are spaced with a first width;

a first radiation portion connected with the connecting portion and being substantially perpendicular to the connecting portion; and a second radiation portion connected with the first radiation portion, the second radiation portion being substantially parallel to the connecting portion and positioned corresponding to the slot, the second radiation portion having two edges that are substantially parallel to each other and spaced with a second width, wherein when the second radiation portion is projected onto the connecting portion along a direction perpendicular to the second radiation portion, one of the edges and one of the corresponding slot sides are substantially parallel to each other and spaced with a distance.

11. The wireless network device in accordance with claim 10, wherein the antenna is a single three-dimensional component integrally formed by stamping an electrically conductive thin metal plate.

12. The wireless network device in accordance with claim 10, wherein the first width is greater than the second width.

13. The wireless network device in accordance with claim 10, wherein the edges extend to have a predetermined length.

14. The wireless network device in accordance with claim 10, wherein a free side of the base radiation portion is of a predetermined shape.

15. The wireless network device in accordance with claim 10, wherein a free side of the base radiation portion includes at least one vertex, and the vertex is substantially the farthest point on the free side away from the connecting portion.

16. The wireless network device in accordance with claim 10, wherein the second radiation portion and the connecting portion are spaced with a distance.

* * * * *